United States Patent [19]

Fish et al.

[11] Patent Number: 4,643,007

[45] Date of Patent: Feb. 17, 1987

[54] DEADBOLT LOCKING SYSTEM

[75] Inventors: Aaron M. Fish, Cote St-Luc; Jean-Paul Dausseing, Laval, both of Canada

[73] Assignee: Ilco-Unican Corp, Rocky Mount, N.C.

[21] Appl. No.: 766,441

[22] Filed: Aug. 19, 1985

[51] Int. Cl.[4] ..... E05B 65/06

[52] U.S. Cl. ..... 70/134; 70/474; 292/169.15; 292/139

[58] Field of Search ..... 70/134, 474, 379 R, 70/380; 292/169.15, 139, 167, 178, 181, 182

[56] References Cited

U.S. PATENT DOCUMENTS

| | | | |
|---|---|---|---|
| 2,714,030 | 7/1955 | Gardner | 292/178 |
| 3,606,422 | 9/1971 | Hennessy | 292/139 |
| 3,636,745 | 1/1972 | Green | 292/341.14 |
| 4,012,929 | 3/1977 | Solovieff | 70/134 |

*Primary Examiner*—Robert L. Wolfe

*Attorney, Agent, or Firm*—Ira Milton Jones

[57] ABSTRACT

A positive deadbolt locking system having a spring-biased deadbolt normally biased toward a retracted unlocked position or selectively and alternatively toward an overcenter locked position. The deadbolt is selectively in the fully unlocked or fully locked position of the locking system.

14 Claims, 7 Drawing Figures

DEADBOLT LOCKING SYSTEM

This invention relates to a locking system and, more particularly, to a spring biased deadbolt locking system whereby the spring biased deadbolt is biased to an unlocked position or to an overcenter deadbolt lock position to avoid partial locking of the locking system.

Many cylindrical type locks on the market protrude beyond the surfaces of the doors. Applicants provide for a door lock essentially the thickness of the door in which the thickness of the door will accept the cylindrical lock.

Many types of locks do not require a full turn of the key to lock or unlock the lock, and consequently if the operator is not very conscious of the operation of the lock, the latch bolt may be allowed to be in a partially locked position. If the door is not fully locked, it is possible it may become unlocked and allow an unauthorized person to gain entrance to a restricted area.

Accordingly, the applicants' invention includes springs which normally bias the lock to a return position or to the fully locked deadlock position to assure the door is secure.

The Eads U.S. Pat. No. 3,073,143 shows a lock with a key operated cam for locking the door. An auxiliary latch bolt is employed for locking the latch bolt in the deadbolt position.

The applicants' deadbolt lock employs a spring operating mechanically to assure positive locking when the door is locked. If the lock is not fully locked, the spring will return the lock to the fully locked position. If the deadbolt is in the overcenter position, it will move to the position where it is fully locked. The springs will assure that the lock is in one of the two positions.

It is an object of this invention to provide a cylinder key lock utilizing the thickness of the door to accept the length of the lock cylinder.

It is another object of this invention to provide a hub operated by a key operated cylinder cam to reciprocate the deadbolt between a locked and an unlocked position with resilient means to assure the lock is in the fully locked or fully unlocked position.

It is a further object of this invention to provide a key operated cylindrical cam to reciprocate a spring biased deadbolt between the locked and the unlocked position.

It is a further object of this invention to provide a key operated cylinder cam operating a hub for reciprocating a spring biased deadbolt between the locked and unlocked positions. The spring assures positive operation of the lock to rest in either a fully locked or fully unlocked position.

The objects of this invention are accomplished by use of a key operated cylinder cam mounted with a hub to rotate or counter-rotate the hub on a concentric axis. The hub is pivotally connected to operate a deadbolt between a locked and an unlocked position. The spring biases the deadbolt to an unlocked position or, if overcenter and holds the deadbolt in the locked position. A detent mechanism is provided which defines the two positions for the deadbolt - either the locked or the fully unlocked positions. The detent augments retaining the lock in the deadbolt locked position or the unlocked position. The detent operates on the hub of the locking mechanism.

Referring to the drawings, the drawings illustrate the preferred embodiment of the invention.

Figure 1:
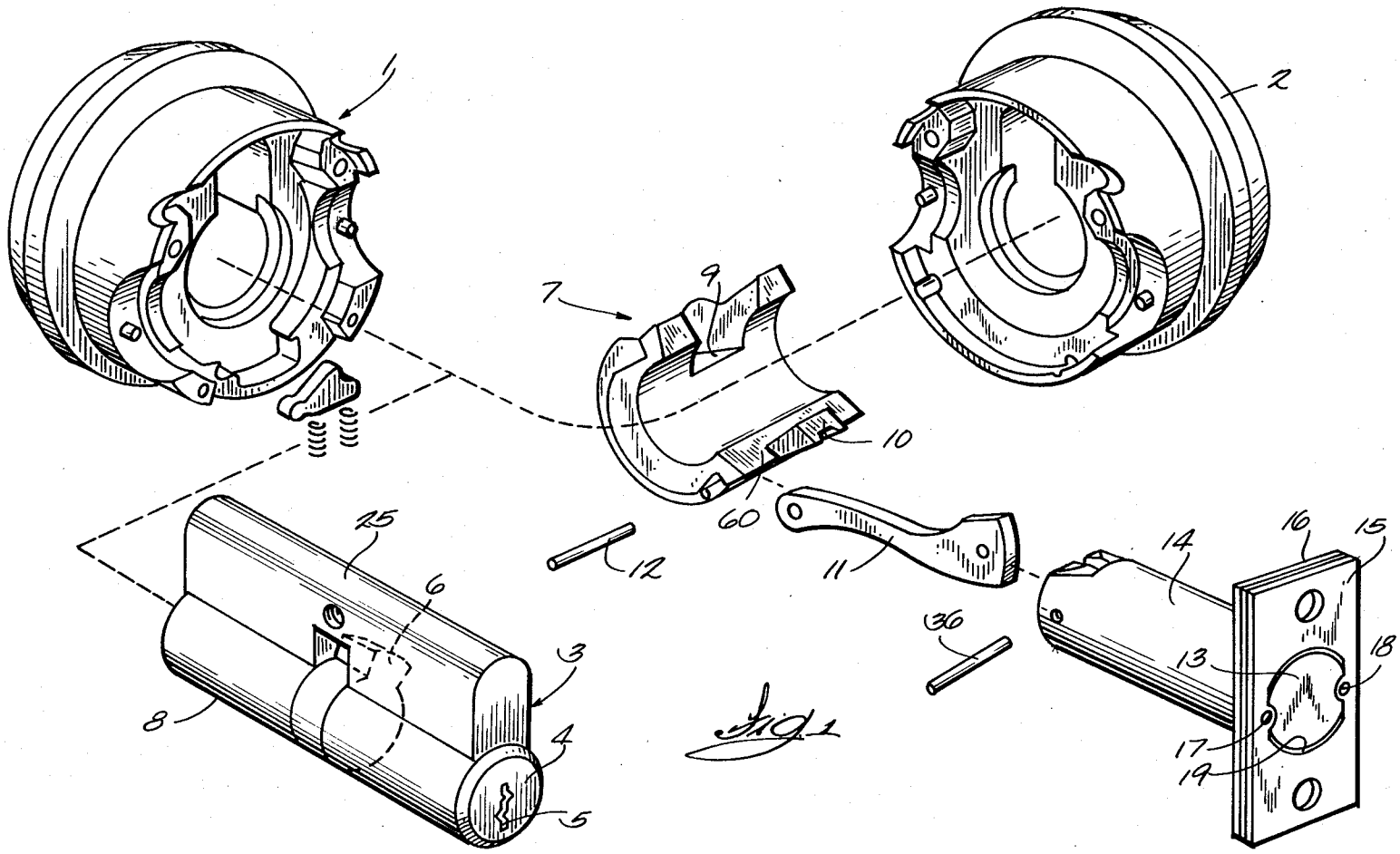
FIG. 1 illustrates an exploded view of the locking mechanism.

Referring to the drawings, FIG. 1 illustrates an exploded view of the locking system. The outside lock body 1 and the inside lock body 2 provide supporting structure for the key cylinder housing 3, which encloses the key cylinder 4. The key cylinder 4 extends all the way through the key cylinder housing 3 and is provided with a key slot 5, as shown, and also a similar key slot on the opposite end of the key cylinder for unlocking the door from the outside of the door. The key cylinder 4 rotates concentrically within the opening in the key cylinder housing 3. The key cylinder housing 3 forms a bridge structure in supporting the key cylinder 4. The key cylinder 4 is integral with the cylinder lock cam 6 which rotates with the key cylinder 4 to also rotate the hub 7. The hub 7 embraces the lower portion 8 of the key cylinder housing 3. The key cylinder lock cam 6 selectively engages the surface 9 on the hub 7 to rotate in one direction, and bears against the surface 10 of the hub 7 to rotate the hub in the opposite direction.

The outside lock body 1 and the inside lock body 2 are mounted on a common axis in the door with a flange portion extending from the door surface. The lock bodies provide support for the key cylinder housing 3. Hub 7 is pivotally connected to a link 11 by a pin 12. Similarly, the link 11 is pivotally connected to the deadbolt 13 by a similar pin 36 within the deadbolt housing 14. The front plate 15 is mounted on the edge of the door and the pin support plate 16 is carried on the two pins 17 and 18 and is provided with an opening similar to the opening 19 shown in the front plate 15.

Figure 2:
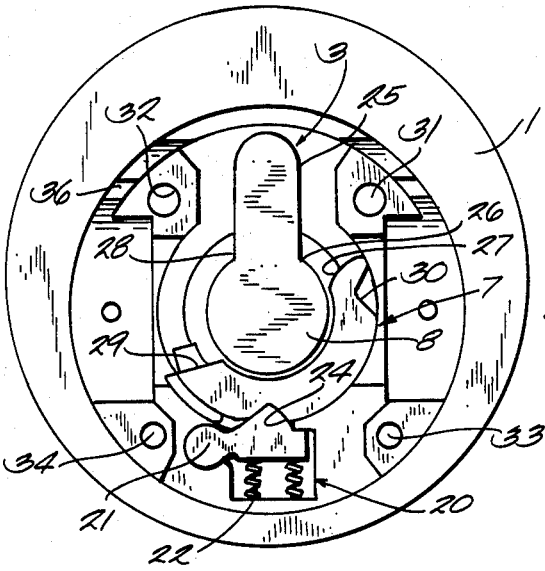
FIG. 2 illustrates a cross section view showing the detent mechanism and the center portion of the lock.

Referring to FIG. 2, the outside lock body 1 is shown with the detent 20. The detent element 21 is biased by the springs 22 and 23 to an engaging position in the notch 24 of the hub 7. The hub 7 is rotatably mounted on the key cylinder housing 3 and can rotate clockwise or counterclockwise to a stop position. The bridge portion 25 of the key cylinder housing 3 forms a stop at the surface 26, engaging the surface 27 on the hub 7, when rotating in a counterclockwise direction, as viewed in FIG. 2. Similarly, the surface 28 forms a stop or abutment when engaging the surface 29 on the hub 7 for rotation in a clockwise direction. The notch 30 forms the detent recess for the hub when the hub is rotated in the clockwise direction and the deadbolt is in the extended or the locked position.

The inside and outside lock bodies are fastened by a plurality of bolts which are received within the openings 31, 32, 33 and 34.

An opening 36 is also provided for a screw which connects to the key cylinder housing 3 when the device is in the assembled position.

Figure 3:
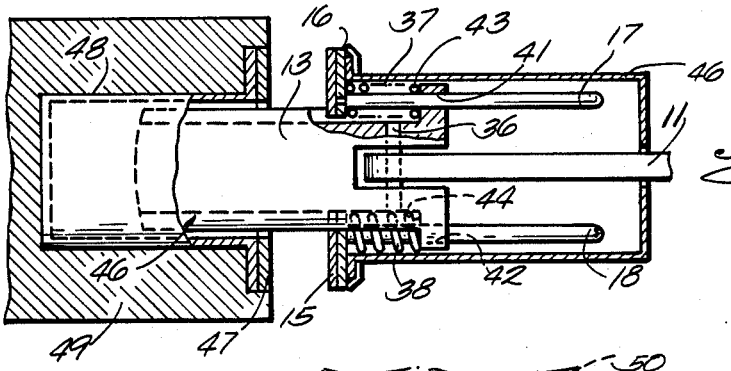
FIG. 3 illustrates a cross section view of the deadbolt in the locked position.
Figure 6:
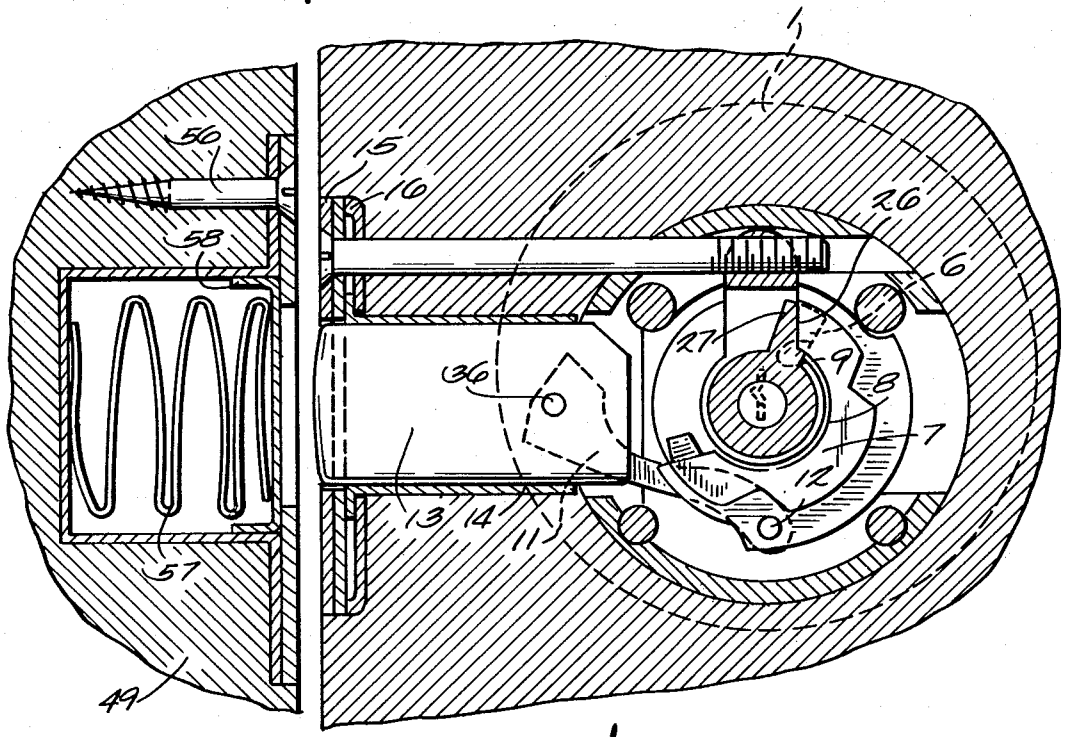
FIG. 6 illustrates a cross section view of the lock in the unlocked position.

FIG. 3 illustrates a cross section view of the deadbolt 13. The deadbolt 13 is connected through the link 11 to the hub 7. The pin 36 pivotally connects the deadbolt 13 to the link 11. The deadbolt is normally biased to a retracted position by the springs 37 and 38 which embrace the pins 17 and 18. The pins 17 and 18 reciprocate within the openings 41 and 42 in the deadbolt. The spring is seated on the spring seats 43 and 44 and also seated on the pin support plate 16. The front plate 15 is mounted on the edge of the door. The deadbolt case 46 is mounted within the edge of the door and carries the deadbolt and the deadbolt assembly, as shown. Similarly, the strike 47 is mounted on the door jamb and it carries the strike box 48. The strike box 48 may be provided with a bellows spring 57, as shown in FIG. 6, to assist the springs 37 and 38 in retracting the deadbolt to a return position. The door jamb 49 carries the strike assembly.

Figure 4:
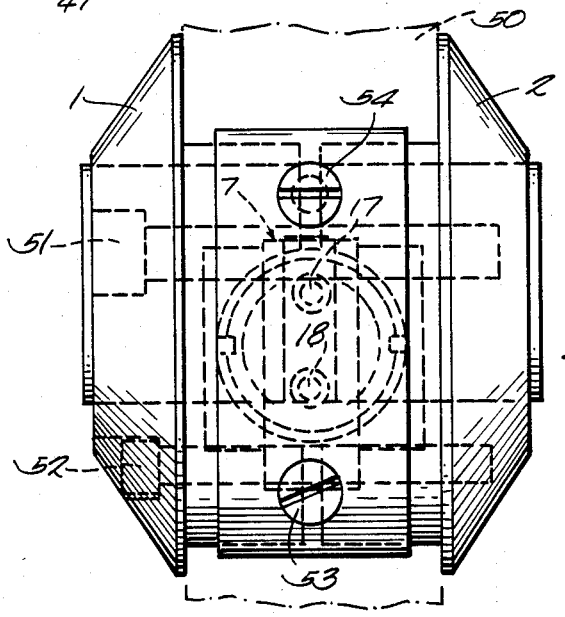
FIG. 4 illustrates a side view of the locking device.

FIG. 4 illustrates a side view of the lock assembly. The door 50 is shown carrying the outside lock body 1 and the inside lock body 2. The lock bodies are fastened by the screws 51 and 52, as shown. Screws 53 and 54 hold the assembly fixed in the door as well.

Figure 5:
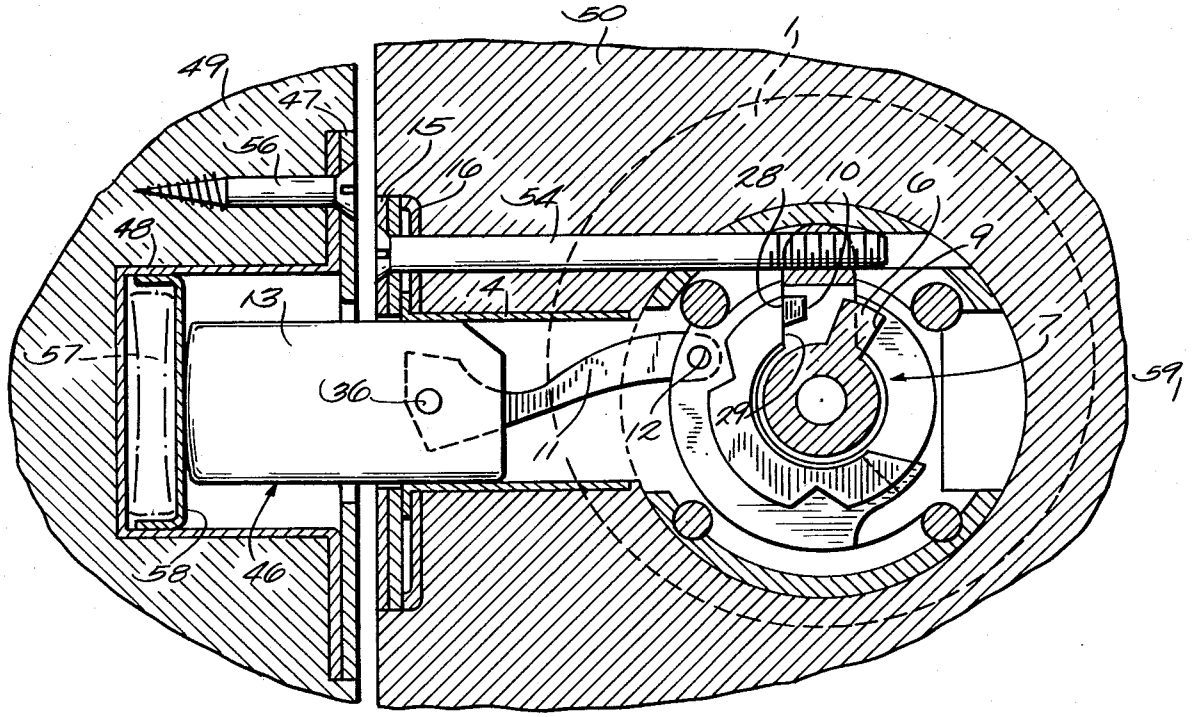
FIG. 5 illustrates a cross section view of the locking device in the locked position.

FIG. 5 illustrates the deadbolt in the locked position. The strike 47 and strike box 48 are fastened by means of a screw 56 and other suitable means, if necessary. The strike box 48 carries the bellows spring 57 within the sliding cup 58. The bellows spring 57 normally biases the deadbolt 13 toward a retracted position.

The deadbolt is shown in the locked position in which the link 11 has moved overcenter of the center line 59. The centerline 59 of the deadbolt extends through the center line of the hub and the lock assembly, and when the connection of link 11 with the hub moves to an overcenter position, the force of the springs operate as a toggle and bring the locking device in the deadbolt position. FIG. 5 illustrates a bellows spring in the strike box for retracting the latch bolt.

This invention provides for use of either a spring in the strike box or springs on the deadbolt, as shown in FIG. 3, or both, whichever is preferred.

The hub 7 is shown in FIG. 5 in the extreme clockwise position in which the surface 29 engages the abutting surface 28.

FIG. 6 illustrates the deadbolt 13 in the unlocked position. The bellows spring 57 has expanded to force the sliding cup 58 to a retracted position. In this position, the hub 7 has been rotated in a counterclockwise direction so that the surface 27 engages the abutment surface 26 on the bridge portion 25 of the key cylinder housing 3. In this position, the deadbolt 13 is completely retracted and remains in this position until the locking mechanism is actuated. If the springs shown in FIG. 3 are used in this assembly, the springs will maintain the deadbolt in the retracted position, otherwise the force of the bellows spring 57 and the inertia of the mechanism will carry it to the retracted position, as shown in FIG. 6.

Figure 7:
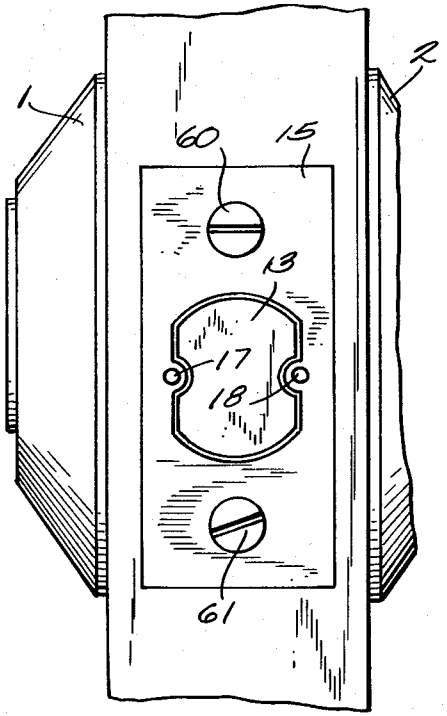
FIG. 7 illustrates a cross section view of the lock showing the end of the deadbolt as shown on line 7—7 of FIG. 6.

FIG. 7 illustrates the face plate 15 fastened by the screws 60 and 61. The operation of the device will be described in the following paragraphs.

FIGS. 5 and 6 illustrate the locking device in the locked position and the unlocked position. When the locking device is to be locked, the key is inserted in the key slot 5 and the key cylinder 4 is rotated in a clockwise direction as viewed in FIG. 6. The key cylinder cam 6 is rotated with the key cylinder 4 in a clockwise direction so that the cam bears against the surface 9, rotating the hub 7 in a clockwise direction. This, in turn, carries the link 11 to the left with the deadbolt 13. The hub 7 is rotated until the axis of the pin 12 passes over the centerline 59 of the deadbolt and the axis of the lock mechanism. When the pin 12 passes over this axis, then the mechanism operates as a toggle and the spring force on the deadbolt or the bellows spring 59 tends to bias the deadbolt toward the hub. Since the link, however, is in a position with its connecting pin 12 above the centerline 59, if the key is released at this point it will move to a locked position, as shown in FIG. 5. The lock will remain in the deadbolt locked position until it is manually unlocked.

If it is desired to unlock the locking mechanism, the key is inserted in the key slot 5 and the key cylinder 4 with the key cylinder cam 6 is rotated in a counterclockwise direction, as viewed in FIG. 5. The key cylinder cam 6 is rotated in a counterclockwise direction until the cam engages the surface 10 on the hub. This rotates the hub in a counterclockwise direction and the link follows with the hub until the pin 12 moves below the centerline 59 and the hub continues to rotate to the position shown in FIG. 6. The continued rotation of the hub 7 is augmented by the springs 37 and 38, as shown in FIG. 3. The springs will continue to rotate the deadbolt and the hub even if pressure is released from the key in the key slot 5. The deadbolt will always return to one of the two positions—the locked position, as shown in FIG. 5, or the unlocked position as shown in FIG. 6. This feature is a safety feature to assure that the door is fully locked or else fully unlocked, and the operator would be aware of the situation.

The embodiments of the invention in which an exclusive property or privilege is claimed are defined as follows:

1. A deadbolt locking system comprising:

a key cylinder, a key cylinder housing defining an opening receiving and rotatably supporting said key cylinder, a hub rotatably mounted on said key cylinder housing, a key cylinder lock cam operated by the key cylinder for rotating and counter-rotating said hub, a deadbolt mounted in a sleeve for reciprocal movement on a reciprocal axis, a link pivotally connected between said hub and said deadbolt and moving to overcenter positions above and below said reciprocal axis of said deadbolt, said key cylinder housing defining a stop engaging said hub defining the extended and locked position of said deadbolt, and a second stop defining the retracted and unlocked position of said deadbolt and overcenter positions of said link when said hub is rotated and counter-rotated by said key cylinder cam, and resilient means compressively mounted between said sleeve and said deadbolt to selectively and alternatively bias said link to the overcenter positions and retain said deadbolt in the locked or unlocked positions.

2. A deadbolt locking system comprising:

a door, an inside lock body mounted on the inside of the door, an outside lock body mounted on the outside of the door coaxially aligned with the inside lock body, a key cylinder housing received in axially aligned openings in said lock bodies, a key cylinder mounted concentrically within said key cylinder housing, a key cylinder lock cam on said key cylinder, a hub mounted for concentrically rotating on said key cylinder housing, a deadbolt reciprocatively mounted radially to said hub and defining a reciprocating axis, a link pivotally connected between said hub and said deadbolt with the hub connection rotating to positions above and below said reciprocating axis, resilient means including a spring biasing said deadbolt toward said hub selectively and alternatively to locked and unlocked positions, means defining spring seats on said door and said deadbolt, and abutment means on said key cylinder housing limiting the rotational movement of said hub in a clockwise and a counterclockwise direction with the hub connection in the above and below center positions and thereby defining the extended and retracted positions of said deadbolt and to assure complete locking or unlocking of said locking system.

3. A deadbolt system comprising:

an inside lock body and an outside lock body each defining an opening with said openings axially aligned, a key cylinder housing non-rotatably received in said openings, a key cylinder received in said housing, a key cylinder lock cam on said key cylinder for rotation with said key cylinder, a hub rotatably mounted on said key cylinder housing, a deadbolt reciprocably mounted radial to said hub, a link pivotally connected to said deadbolt and pivotally connected eccentrically to said hub, resilient means normally biasing said deadbolt towards said hub and rotating the pivotal connection between said link and hub to an overcenter and an undercenter position as a toggle, and abutment means on said key cylinder housing selectively and alternatively engaging said hub for limiting rotational clockwise and counterclockwise rotation of said hub and defining the extended or locked position and the retracted or unlocked position of said deadbolt, said resilient means biasing said hub selectively and alternatively to engaging position with said abutment means on said key cylinder housing, in which said abutment means defines fully locked and unlocked positions of said deadbolt with said link connection with said hub in the overcenter and undercenter positions.

4. A deadbolt locking system as set forth in claim 1, wherein said cylinder housing defines a bridge structure, said key cylinder extending through an opening formed by said bridge structure, and wherein said key lock cam is pivotally supported for selectively engaging said hub for rotation and counterrotation.

5. A deadbolt locking system as set forth in claim 1, including a deadbolt housing reciprocably guiding said deadbolt.

6. A deadbolt locking system as set forth in claim 3, wherein said resilient means defines a spring on said deadbolt normally biasing said deadbolt to a retracted position towards said hub.

7. A deadbolt locking system as set forth in claim 3, including a door jamb, a strike means in said door jamb, resilient means in said strike means for biasing said deadbolt to a retracted position.

8. A deadbolt locking system as set forth in claim 2, wherein said resilient means defines springs, springways formed in said deadbolt to accommodate positioning said springs, means defining spring seats on said deadbolt, and a base plate on said door defining spring seats.

9. A deadbolt locking system as set forth in claim 2, including means defining a rotatable axis for said hub, said hub rotating the link end connected to said hub above the rotatable axis to thereby provide a toggle effect for locking of said lock when said deadbolt is moved to the locking position.

10. A deadbolt locking system as set forth in claim 2, including means defining a detent defining two positions of said hub and the locking and unlocking positions of said deadbolt.

11. A deadbolt locking system as set forth in claim 3, wherein said deadbolt defines a reciprocating axis, said hub defines a rotatable axis intersecting said deadbolt axis, said hub and link defining a pivotal axis which moves selectively and alternatively to a position above said axis to lock said locking system and to a position below said axis to define an unlocking position for said locking system.

12. A deadbolt locking system as set forth in claim 1, wherein said hub and said key cylinder housing form interlock connections when said hub engages said key cylinder housing to define deadbolt locking and unlocking positions.

13. A deadbolt locking system as set forth in claim 3, wherein said pivotal connection between said link and said deadbolt defines a linear motion, said pivotal connection between said hub and said link defines a circular motion, said hub defines a rotating axis, said deadbolt defines a reciprocating axis, movement of said locking system to a deadbolt locking position moving said pivotal connection of said link and hub above said reciprocating axis, and unlocking of said locking system moving the pivotal connection of said hub and link below reciprocating axis.

14. The deadbolt locking system as set forth in claim 1, including a pivotal connection including a pin connecting said link to said deadbolt defining a reciprocal movement, a pin forming a pivotal connection between said hub and the other end of said link defining a rotary movement.

* * * * *